United States Patent [19]

O'Connell

[11] 4,450,954

[45] May 29, 1984

[54] ELECTROSTATIC SPRAY SUPPORT

[75] Inventor: William F. O'Connell, St. Charles, Ill.

[73] Assignee: Graco Inc., Minneapolis, Minn.

[21] Appl. No.: 342,061

[22] Filed: Jan. 25, 1982

[51] Int. Cl.[3] ..... B05B 5/00

[52] U.S. Cl. ..... 198/793; 118/500; 118/624; 118/630; 198/691

[58] Field of Search ..... 118/500, 624, 625, 628, 118/630, 635, 631, 632, 633, 634; 427/33; 198/691, 655, 793, 850

[56] References Cited

U.S. PATENT DOCUMENTS

| | | | |
|---|---|---|---|
| 2,730,988 | 1/1956 | Starkey | 118/635 |
| 2,877,740 | 3/1959 | Friderici | 118/635 |
| 4,168,676 | 9/1979 | Itoh | 118/624 X |

*Primary Examiner*—John D. Smith
*Assistant Examiner*—Bernard F. Plantz

[57] ABSTRACT

A support fixture for holding irregular shaped nonconductive articles for electrostatic paint spraying on a conveyer line, particularly plastic molded articles usable as components in the manufacture of automobiles, having a conductive bracket for grounded attachment to a conveyor line, a conductive frame attached to the bracket and molded into a nonconducting surface area generally conforming to the irregular shape of the articles to be painted, and having electrically conductive sheets molded into the nonconducting surface area and electrically coupled to the grounded bracket for enhancing the electrostatic forces and thereby improving paint deposition over the irregular shaped article.

7 Claims, 3 Drawing Figures

ELECTROSTATIC SPRAY SUPPORT

BACKGROUND OF THE INVENTION

This invention relates generally to fixtures for conveying parts to be sprayed on a paint spray assembly line. More particularly, the invention relates to electrostatic paint spraying of nonconductive parts and articles, preferably where such parts and articles are large and irregular shaped and adapted for use as components of automobile and truck manufacture.

In recent years automobile construction has increasingly become dependent upon the use of component parts made from plastics and other flexible, nonconductive materials. Such materials prove advantageous from both the cost and weight standpoint, and when used as nonstructural components of an automobile they serve their intended function equally as well as sheet metal parts formerly served. Frequently such parts are found in the interior of the automobile in such places as the dashboard, door panels, etc. They are also found frequently in the front and rear of the automobile, forming "fascia" bridging between the automobile bumper and body. Such parts are usually manufactured from reaction injected molded urethane, which provides a smooth exterior finish and which may be painted to match the external body colors of the vehicle.

However, the painting process of such urethane parts requires relatively high paint cure temperatures, in the neighborhood of 250° F., and at such temperatures these urethane parts tend to deform and sag if unsupported. It is therefore necessary to provide some form of support and backing material for these parts during the paint curing process.

In the past, support fixtures for urethane parts have been manufactured from both conductive and nonconductive material. In the case of a conveyor line spray both utilizing conventional air spray guns, the choice of spray support fixture is only of secondary importance, for the spray guns are typically directed, using manual or automatic means, to be positioned to uniformly coat all portions of the fascia surface. Since these surfaces are frequently very irregular, being formed to cover the space between wrap-around automobile bumpers and fender and grill work, the use of air spray guns frequently required a paint spray gun operator to ensure that all surfaces were uniformly and adequately coated.

The use of electrostatic paint spraying equipment is increasingly being utilized by the automobile manufacturing companies, primarily because of the lower amounts of paint overspray which are generated by this type of equipment. Less paint overspray means that less paint is required to uniformly coat a given article, and also means that less waste paint must be collected and recovered from the atmosphere. Both of these factors tend to reduce the cost of the spray painting operation of automobiles. Electrostatic paint spraying techniques have been difficult to apply to nonconductive parts such as the urethane fascia herein described, for these nonconductive parts are not easily conditioned to provide the voltage attraction forces necessary for electrostatic spraying. The well known characteristic of electrostatic paint spraying, namely improved "wrap", which enhances uniformity of coating on irregular surfaces, is difficult to achieve when electrostatically spraying nonconductive parts. Therefore electrostatic spray equipment, for all its other advantages, has proven less than completely effective in the spraying of such parts.

SUMMARY OF THE INVENTION

The present invention overcomes the shortcomings and disadvantages of electrostatic spraying of nonconductive parts having irregular shapes, through the utilization of a spray support fixture which partially nests into the part during the spraying and curing process, and is adapted for coupling to a typical factory conveyor line. The spray support fixture includes a conductive bracket adapted for attachment to the conveyor line and a conductive frame attached to the bracket. A nonconductive surface area, preferably made from fiberglass, is affixed against the frame and has a surface area generally conforming to the irregular shape of the nonconductive articles to be painted. Imbedded into the nonconductive surface area are one or more conductive sheets of metal. These metal sheets are positioned adjacent particularly irregular portions of the surface area which are characteristically difficult to paint using electrostatic techniques. The conductive sheets are electrically connected to the conductive frame and bracket, and thereby provide a surface area for the interaction of the electrostatic forces which enhance this form of paint spraying.

BRIEF DESCRIPTION OF THE DRAWINGS

A preferred embodiment of the present invention is described in the following specification, and with reference to the appended drawings, in which.

DESCRIPTION OF THE PREFERRED EMBODIMENT

Figure 1:
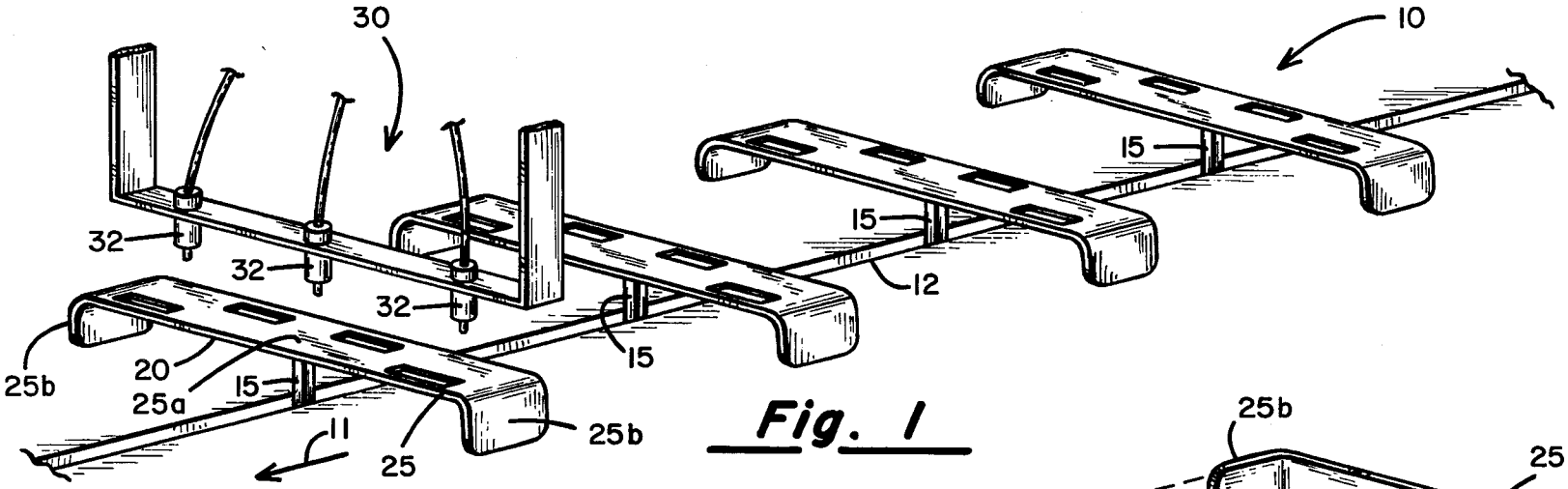
FIG. 1 shows a pictorial view of a conveyor line paint spraying system.

Referring first to FIG. 1, there is shown a conveyor line 10 in pictorial view, which is representative of the form of conveyor lines utilized in automobile manufacturing plants. A track 12 is recessed into the floor, and contains a driving chain or other mode of drive means moving generally in the direction of arrow 11. A plurality of brackets 15 may be coupled in grounded attachment into the drive means associated with track 12 at spaced intervals, whereby the brackets 15 are conveyed along conveyor line 10. Each of the brackets 15 are attached to a conveyor support fixture, generally designated as 20, which hold a part 25 to be sprayed. In FIG. 1, the parts to be sprayed 25 are positioned generally horizontally, although it is to be recognized that other configurations and positions are possible in conjunction with the present invention.

At an appropriate point along conveyor line 10 a paint station 30 is provided. Paint station 30 includes a plurality of paint spray guns 32 which are actuated as a part 25 moves under the paint station, to provide a uniform coating of paint over the surface area of part 25. It is to be noted that part 25 is generally irregular in shape, and in the illustration of FIG. 1 includes a generally horizontal portion **25*a* and a generally orthogonal portion 25*b*. This configuration is typical of the nature and form of parts to be painted by the automobile manufacturing industry. The spray painting characteristics of spray guns 32 are adjusted so as to provide a uniform paint film coating over the entire surface 25***a*, and with the utilization of the present invention to also provide the same uniform film coating over surfaces 25*b*.

Figure 2:
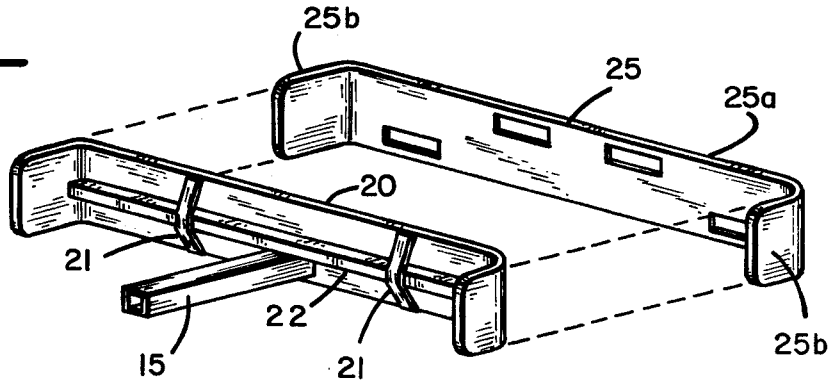
FIG. 2 shows the invention and an irregular-shaped article to be painted.

FIG. 2 shows an isometric view of conveyor support fixture 20 and a typical part 25. Support fixture 20 is sized to nest at least partially into the irregular shape of part 25, so as to form a full and complete support surface for all of the irregular surface features of part 25. The back side of support fixture 20 has a rigid frame 22 attached thereto, frame 22 also being affixed by a weldment or other convenient means to bracket 15. Frame 22 may have any geometric configuration found necessary and convenient for the particular support fixture design for a specific part. If necessary, frame 22 may have vertical support members 21 in order to provide a more rigid support fixture 20. The respective ends of frame 22 are each electrically and mechanically connected to a metallic sheet 24. Metallic sheet 24 is formed of a particular area and shape for any particular part being sprayed according to the principles hereinafter recited, and sheet 24 may be molded into the surface area of support fixture 20, if the surface area is constructed of fiberglass or similar material. Sheet 24 may be a metallic plate or metallic powder, and may be formed into the body of support fixture 20. This is particularly advantageous when support fixture 20 is constructed of fiberglass in a mold, for sheet 24 may then be molded into the body of fixture 20.

Figure 3:
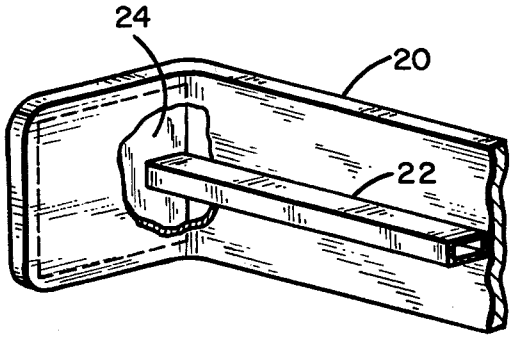
FIG. 3 is an expanded view of a portion of the invention.

FIG. 3 shows an expanded view of a portion of support fixture 20, illustrating the connection between frame 22 and metallic sheet 24. It is to be noted from the figures that metallic sheet 24 is generally disposed along an irregular surface section corresponding to the most irregular surface portions of part 25. In the example of FIG. 3, a "wraparound" part is contemplated having generally orthogonal surfaces 25*b* extending from a generally flat surface 25*a*. In this case, sheet 24 is positioned so as to be adjacent the irregular and orthogonal portions 25*b* for reasons which will be hereinafter described. Other configurations of parts are equally well suited to the principles of the present invention, and it may be generally stated that sheet 24 or a portion thereof may be selectively positioned adjacent any irregular surface area of a nonconductive part so as to enhance the spray coating film uniformity in that area.

In operation, the irregular shaped part 25 is nested over support fixture 20 during a preparatory step to the spray painting process. Once this is done, support fixture 20 is coupled to a conveyor line via bracket 15, and is propelled along the conveyor line toward a paint spray station 30. The part to be sprayed is generally horizontally positioned and upwardly facing, to be in receiving relationship to the spray guns in paint station 30.

It is presumed that the spray guns in spray station 30 are of conventional electrostatic type, and are triggered by movement and position of conveyor line 10 according to principles which are well known in the art. As the irregular shaped part 25 approaches a position beneath the spray guns the spray guns are actuated to provide an electrostatic charge current and paint emission toward part 25. The electrostatic spray forces generated by their respective guns are deflected and, to a large extent concentrated, by virtue of the presence of the metal sheet 24 selectively positioned behind an irregular portion of part 25. This results in an increased density of electrostatic field lines of force developed between the spray guns and the region adjacent sheet 24, and tends to convey proportionally larger quantities of paint toward that region. The generally horizontal portion 25*a* of part 25, being directly beneath the spray guns, received very little electrostatic assistance in the spray operation, for little is needed, and the net result is that the entire surface of part 25 is uniformly coated with paint.

In a typical operation it has been found that spray guns positioned approximately 12 inches above a moving conveyor line part can uniformly deposit 0.0006 inches of paint film thickness over the entire exterior surface area of the part, even when the part has generally orthogonal "wraparound" features.

It is necessary to design the shape and configuration of support fixture 20 and sheet 24 according to the particular needs and configuration of a particular part, but once this has been accomplished the configuration may be reproduced many times in order to convey a great many identical parts through the conveyor spray system. The invention has been proven to eliminate any follow up and touch up operations which are otherwise required in such operations, and has provided the maximum utilization of a limited quantity of paint for this operation.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A support fixture for holding irregular shaped nonconductive articles for electrostatic paint spraying on an electrically grounded conveyor line, comprising:

(a) a nonconductive surface area conforming to said irregular shaped articles and having one side adapted for at least partially nesting against said irregular shaped articles;

(b) a conductive frame affixed to said nonconductive surface area on the side away from said one side adapted for nesting;

(c) a conductive bracket attached to said frame and adapted for mechanical and electrical coupling to said conveyor line; and (d) a conductive surface area affixed against an irregular portion of said nonconductive surface area, and electrically connected to said conductive frame.

2. The apparatus of claim 1, wherein said nonconductive surface area includes at least a first portion of surface area generally orthogonal to a second portion of surface area.

3. The apparatus of claim 2, wherein said conductive surface area is affixed against said first portion of surface area.

4. The apparatus of claim 3, wherein said nonconductive surface area is formed of fiberglass material.

5. The apparatus of claim 4, wherein said conductive surfaces area is molded into said fiberglass material.

6. The apparatus of claim 5, wherein said conductive frame is molded into said fiberglass material.

7. The apparatus of claim 6, wherein said conductive bracket is welded to said conductive frame.

* * * * *